United States Patent [19]

Rosenberg et al.

[11] 4,172,830

[45] Oct. 30, 1979

[54] WATERPROOFING STRUCTURE AND METHOD OF USING SAME

[75] Inventors: Arnold M. Rosenberg, Potomac; James M. Gaidis, Ellicott City, both of Md.

[73] Assignee: W. R. Grace & Co., New York, N.Y.

[21] Appl. No.: 851,066

[22] Filed: Nov. 14, 1977

[51] Int. Cl.[2] ..... B32B 7/00

[52] U.S. Cl. ..... 428/245; 156/71; 156/249; 428/260; 428/284; 428/343; 428/489

[58] Field of Search ..... 428/192, 196, 246, 247, 428/250, 251, 252, 282, 284, 285, 286, 343, 354, 489; 156/71, 249

[56] References Cited

U.S. PATENT DOCUMENTS

| | | | |
|---|---|---|---|
| 3,769,147 | 10/1973 | Homendat | 156/249 |
| 3,950,580 | 4/1976 | Boudet | 156/249 |

*Primary Examiner*—James J. Bell

*Attorney, Agent, or Firm*—Howard J. Troffkin; William W. McDowell, Jr.

[57] ABSTRACT

A novel preformed, sheet-like, flexible material suitable for waterproofing or substructural surfaces, the sheet-like material having a laminate structure of (1) a waterproof and waterproofing pressure-sensitive adhesive membrane having a surface of predetermined width extending from edge to edge of said membrane; and (2) a support covering said entire predetermined width of said surface, said support comprising (a) a major flexible support sheet superimposed on a major portion of said surface, and (b) at least one minor support sheet, each of said at least one minor support sheets extending from one of said edges toward the major support sheet. The flexible polymeric support covering the major portion of the membrane's covered surface has its free face substantially non-adherent to the composition of the waterproofing adhesive membrane. Each of the flexible polymeric support(s) covering the minor portion(s) of the membrane's covered surface has both faces substantially non-adherent to the waterproofing adhesive membrane. The novel structural material can be in the form of rolls comprising alternate layers of membrane and support coverings which can be readily applied to a substructure by unrolling and removing the support sheet covering the minor portion of the membrane. The exposed portion of membrane permits overlapping application of the next course of waterproofing structural material to give good mastic to mastic bonding.

13 Claims, No Drawings

WATERPROOFING STRUCTURE AND METHOD OF USING SAME

BACKGROUND OF THE INVENTION

This invention relates to novel waterproofing sealants which are in the form of a pre-formed sheet-like structure. The present sheet-like structure permits application to a substructure surface with overlapping in a manner which gives good mastic to mastic bonding to assure sound waterproofing seals without the need for a protective sheet on the free mastic surface.

It is known that substructural surfaces and the like, such as those formed of concrete, can be sealed in a waterproof manner by forming thereon a continuous membrane of a bituminous composition which is substantially impermeable to moisture. The term "bituminous composition" as used in the present disclosure refers to compositions based on tar, asphalt or pitch, with or without added components. In the past such waterproofing membranes have been formed by in situ application of a hot bituminous composition or of a cold solution or emulsion of bitumen, tar or pitch.

These known methods suffer serious disadvantages. The procedures require the formation of the layer of waterproofing sealant at the job site which does not permit the assurance of a uniform application nor of a resultant uniform layer. In addition, such application causes additional expenses of labor at the job site. Finally, application of such waterproofing sealants to vertical substructural members is both tedious and unmanageable.

More recently waterproofing of substructural members has been accomplished by the application of preformed, flexible membranes of waterproofing pressure-sensitive adhesives such as those disclosed in U.S. Pat. Nos. 3,741,856, 3,853,682, and 3,900,102. These waterproofing materials have a laminate structure comprising a sheet-like support member having a membrane of a flexible bituminous composition superimposed thereon. The bituminous composition may be single or multilayered and has adhesive properties which render it adherent to the support and to the substrate material to which it is applied.

Generally, known preformed waterproofing structures have a support sheet and a membrane of bituminous composition which are coextensive and, in addition, have a protective sheet on the free surface of the membrane which must be removed upon application of the waterproofing structure to the substructure. Formation of a waterproofing seal between courses of preformed waterproofing structures is presently attempted by overlapping the courses and relying on the membrane cold flowing beyond the edge of the support sheet to bond with the free mastic surface of the lapped structure. Such bonds are apt to be defective because of poor intimate contact.

Waterproofing structures have been formed with mastic membranes extending short distances beyond the support sheet to yield a partially exposed surface. These require a protective sheet on the free surface of the mastic to prevent its bonding with the partially exposed surface during packaging and storage. Such protective sheets present the problems of removal and disposal at the job site of the additional protective sheet.

Some structures, such as disclosed in U.S. Pat. No. 4,039,706, have their free major surface formed of a nonadherent material and rely on the application of multiple layers of the structure on the subsurface in an attempt to achieve adequate waterproofing. The second and subsequent layers can be applied parallel to each other with any one course of a layer overlapping the seam formed by the two adjacent courses of the previously applied layer or the layers can be applied in a criss-cross manner with respect to the previously applied layer. The release sheet may be perforated to enable its removal at one time or to permit tearing of such sheets for its removal in sections as the next layer of waterproofing structure is being applied. These structures have the drawbacks of requiring the application of multiple layers in an attempt to achieve waterproofing. Such multilayer application is costly due to the amount of material used and to the labor required. Further, because the free major surface of the structure is of a non-adherent material, one can not be assured, even after application of multiple layers, of obtaining satisfactory waterproofing. In addition, the problems of removal and disposal of the release sheet at the job site are compounded by the required application of multiple layers.

SUMMARY OF THE INVENTION

The present invention is directed to a novel flexible preformed waterproofing structure which permits a large mastic to mastic surface contact without the need of a protective sheet on the membrane's free surface. The present waterproofing structure comprises a laminate structure of a waterproofing flexible pressure sensitive adhesive membrane having a major surface of predetermined width extending from edge to edge (the term "edge" as used herein refers to the long edges of the formed laminate structure or its components) of said membrane and a flexible polymeric support covering the entire predetermined width of one major surface of the membrane. The support is composed of a first polymeric sheet superimposed on a major portion of the surfaced membrane and at least one second polymeric sheet superimposed on a minor portion of the surface, each of the second polymeric sheet extending from the one edge of the membrane. The first support sheet having one face adherently affixed to the membrane and the second face substantially non-adherent to the composition of the membrane. Each of the second support sheets has both major faces substantially non-adherent to the composition of the membrane.

DETAILED DESCRIPTION OF THE INVENTION

The preformed, flexible waterproofing material of the present invention is composed of a flexible polymeric support which is in face-to-face adherent relationship with a waterproof and waterproofing adhesive membrane. The support is composed of support sheet components, which permits mechanical stability of the membrane during production, storage, transportation and use while, upon application, permitting exposure of a portion of the membrane to achieve good mastic to mastic bonding and assure waterproof seams.

The support of the waterproofing structure of the present invention has the non-facing surfaces and the facing surface of each of the at least one minor support sheets substantially non-adherent to the composition of the membrane. The structure can be formed into rolls for storage and transportation to the job site and readily unrolled and applied to the substrate surface. The minor support sheet can then be removed from the membrane to expose a surface of the membrane readily available to produce a mastic to mastic seal of good waterproofing characteristics. The flexible adhesive membrane can be formed from a variety of compositions or, if desired, can be composed of a plurality of layers of waterproofing compositions composed of the same or different conventional components for this purpose, providing both major surfaces are of adhesive compositions.

A variety of adhesives can be used in forming the waterproofing membrane provided that the formed membrane is capable of adhering to the facing surface of an untreated polymeric support sheet, as described hereinbelow. Further, the membrane should be capable of adhering to the surface of the substructure without the use of heat or additional bonding agents. Adhesives of bituminous compositions are generally suitable, especially those formed of natural or synthetic rubber, virgin or reclaimed, blended into bitumen to provide a smooth mix. The ratio by weight of bitumen to rubber can be 75:25, preferably greater than 80:20 to about 95:5 and most preferably 90:10. Other types of contact adhesive compositions, including polychloroprene, butyl rubber, oil based mastics and the like can be used. Generally, compositions which are suitable have softening points (measured by the Ring and Ball method) of 60° to 140° C., preferably of 60° to 110° C., and penetration values of 50 to 400, preferably between 150 to 300 at 25° C. (100 g. 5 sec. I.P. method).

The adhesive membrane should be at least 0.05 cm thick and preferably 0.06 to 0.5 cm thick. The thicker the membrane the better the waterproofing effect and, therefore, the upper end of this range is preferred.

A wide variety of materials can be used as the support sheets which form parts of the novel waterproofing structure of the present invention. It is desirable that the support be formed of material which is impermeable to water. Further, it is desirable that the support be capable of stretching with any movement of the substructure. To this end the laminate structure of support and waterproofing membrane should have an elongation at break of at least about 300 percent (at 20° C.) and a tensile strength of at least about 1.5 kg per cm. However, where stretchability and flexibility are less important, supports not fulfilling these requirements can be used.

The support sheets can be formed from polymeric materials such as polyolefins, for example, polyethylene, polypropylene and the like, polyamides, polyesters, for example, polyethylene terephthalate, polyurethanes, polyvinyl halides, for example polyvinyl chloride or copolymers thereof and the like. The support sheets can be in the form of a film or a fabric which is woven or nonwoven. The fabric can be formed from the polymeric materials described above as well as inorganic fibers such as formed from glass. Other features of conventional support materials can be incorporated in support sheets useful in forming the laminate structure of the present invention. The support sheets can be of any thickness for forming a flexible laminate structure having the desired physical properties. Thicknesses of from about 0.001 to 0.05 cm are suitable for most applications.

The laminate structure which forms the novel waterproofing material of the present invention has a support formed of support sheet components as described hereinbelow which enables the present waterproofing material to be formed, stored, transported and applied to a substructure without the need of an additional protective sheet while permitting the exposure of a sufficient expanse of adhesive (mastic) membrane to ensure good mastic to mastic bonding and waterproof seams. The support is composed of a first or major support sheet which is superimposed in a face-to-face relationship with a major portion of the facing surface of the waterproofing adhesive membrane. This first or major support sheet has a surface which is in face-to-face relationship with the waterproofing adhesive membrane to be adherently affixed thereto and has its opposite free surface substantially non-adherent to the composition of the membrane. Where the membrane is in the form of multiple layers, the free surface of the first support sheet should be non-adherent with respect to laminate composition forming the free adhesive surface of the membrane. The non-adherent property of the surface of the support sheet can be accomplished in manners described hereinbelow.

The support further comprises at least one minor or second support sheet, each of the at least one minor support sheets is superimposed on a minor portion of and extending from one edge of the waterproofing adhesive membrane. The combination of the major and minor support sheets should be positioned in a manner that the combination covers the entire one major surface of the membrane. Some overlapping of the support sheets may occur. Both faces of the minor support sheet are substantially non-adherent with respect to the composition of the membrane. Preferably, the face of the minor support sheet which is in face-to-face relationship with the surface of the membrane is non-adherent to a lesser degree than the opposite free face of the support sheet. Where the membrane is formed of multiple layers, the faces of the minor support sheet are substantially non-adherent to the facing and exposed layers forming the membranes and, preferably, the face of the minor support sheet adjacent to the membrane is non-adherent to a lesser degree to the surface of the membrane than is the exposed face of the support sheet to the exposed surface of the membrane. The method of forming a non-adherent surface is described hereinbelow.

The support can thus comprise a combination of two support sheets which, together, extend from edge to edge of the membrane. This combination is made up of (1) a first or major flexible polymeric support sheet superimposed on a major portion of the one covered surface and extending to one edge of the waterproofing adhesive membrane; and (2) a second or minor flexible polymeric support sheet superimposed on the remaining minor portion of the same one covered surface and extending to the opposite edge of the membrane. Alternately, the support can comprise a combination of three support sheets which, together, extend from edge to edge of the membrane. This combination is formed of (A) a major flexible polymeric support sheet superimposed on a major portion of the one covered surface of the waterproofing adhesive membrane; (B) a first minor flexible polymeric support sheet which is superimposed on a minor portion of the one covered surface and extending from one edge of the membrane towards the major support sheet (A); and (C) a second minor flexible polymeric support sheet which is superimposed on a minor portion of the one covered surface and extending from the opposite edge of the membrane toward the major support sheet (A). The edge of each of the minor support sheets which extend inwardly is either substantially adjacent to or overlaps the inner edge of the major support sheet.

The support composed of the combination of three support sheets as described hereinabove is preferred as it permits the application of the waterproofing structure on the substructure surface without the need of the applier noting the orientation of the minor support sheet prior to application of each course.

Each of the minor support sheets covers a minor portion of the surface of the waterproofing adhesive membrane. This portion should be of a width substantially equal to the desired overlapping of the next membrane when applied and which assures that the overlapping membranes produce good mastic to mastic bonding and, therefore, a good waterproofing seal. The width of each minor support sheet should, therefore, be at least about 2.5 cm, widths of from 3 cm to about 20 cm being preferred, with from about 5 cm to 10 cm being most preferred. Generally, the total width of the minor support sheets should not be greater than about half the width of the major support sheet.

The surfaces of the support sheets can be made non-adherent with respect to the adhesive composition of the membrane by known techniques. For example, a commercial release coating can be applied in conventional manners to the surface of the support sheets, such as by the application of a dispersion of silicon compound which is cured with the aid of catalyst and/or heat and forced ventilation. Known release agents such as, for example, poly(dimethylsiloxane) give good non-adherent properties and known agents giving non-adherent properties to a lesser degree in comparison to the above agents are, for example, modified poly(dimethylsiloxane)s having a fraction of the methyl groups replaced by hydrogen, a higher alkyl or a phenyl group.

The novel flexible materials having the laminate structure described hereinabove are useful in providing a waterproofing barrier over a surface of a substructure, particularly substructures formed of concrete. The water-proofing protective coating is formed by applying the exposed surface of the membrane to the substructure surface. When rolls of the subject laminate structure are used, they are simply unrolled with the exposed surface of the membrane applied to the substructure surface to be sealed. The applied waterproofing laminate structure then has the support exposed, whereupon support sheet covering the minor portion of the membrane, which is adjacent to the substructural surface upon which the next course of waterproofing structure is to be applied, can be readily removed to produce a desired exposed width of membrane. Application of the neighboring waterproofing structure is then done by overlapping the neighboring waterproofing material over the exposed width of the previously applied membrane as well as over additional substructure surface. The overlap thus produces a mastic to mastic contact of substantial width which readily assures bonding and a waterproof seal. The process can thus be repeated to produce a continuous waterproof seal over the entire substructure surface.

The width of the overall waterproofing structure of the present invention can vary widely depending upon the ultimate use. Generally, widths of from about 15 cm to 120 cm and greater can be used with widths of from about 15 cm to 90 cm being preferred, and from about 60 to 90 cm being most preferred. It is realized that the greater the width the fewer seams and overlapping is needed to cover an expanse of substructure. Very large widths are limited only by the inconvenience of the size for application.

The novel structure of the subject invention can be formed without difficulty by known techniques. The use of adhesives which are not solvent-based and can be formed from hot compositions are preferred. Thus, such adhesives can be applied hot, with the aid of a suitable device to insure a uniform thickness, to a non-adherent substrate forming material which can be removed at the end of the manufacturing process. The support sheets described above are superimposed on the formed membrane in accordance with the orientation described hereinabove. Other conventional techniques may be used to form the present novel structure.

The following example is for illustrative purposes only and is not to limit the invention except as defined by the claims set forth below. All parts and percentages are by weight except where otherwise indicated.

EXAMPLE

A flexible waterproofing material was formed by applying a coating of a hot bituminous composition consisting of 10 parts by weight natural rubber and 90 parts by weight of bitumen on a continuous belt having a paper coated with a silicon release agent thereon. The coating was made 0.3 cm thick and 90 cm wide. Support sheets of polyethylene film having widths of 80 cm and 10 cm respectively and each having a thickness of 0.02 cm were applied to the formed membrane so as to fully extend from edge to edge the width of the membrane. The 80 cm wide support sheet was previously coated with poly(dimethylsiloxane) release agent on one face; that face being orientated away from the membrane. The 10 cm wide support sheet was previously precoated with poly(dimethylsiloxane) release agent on the face oriented away from the membrane and precoated with a poly(dimethylsiloxane) having 3 percent of the methyl groups substituted by hydrogen, a weaker release agent, on the face in contact with the membrane. The laminate structure of the membrane with the support sheets thereon are removed from the continuous belt with the release sheet thereon and formed into rolls for shipment and application. The release sheet is separately removed and formed into rolls for reuse.

The roll of laminate structure was applied over a concrete roof by unrolling with the free adhesive surface adjacent to the concrete. After application of one course of the laminate structure, the 10 cm wide support sheet was removed exposing a 10 cm wide surface of the membrane. The next course of laminate structure was then applied with overlapping over the exposed membrane surface. A waterproof seal for the concrete roof was thus obtained.

While the invention has been described in connection with one of the preferred embodiments, it is not intended to limit the invention to the particular form set forth, but, on the contrary, it is intended to cover such alternatives, modifications and equivalents as may be included within the spirit and scope of the invention as defined by the appended claims.

What is claimed is:

1. A preformed, flexible sheet-like waterproofing material, comprising a laminate structure of (1) a waterproof and waterproofing, flexible, pressure sensitive adhesive membrane having a surface of a width extending from edge to edge of said membrane; and (2) a support, covering said entire width of said surface, comprising (a) a major flexible support sheet superimposed on a major portion of said surface, and (b) at least one minor support sheet superimposed on a minor portion of said surface and extending from one of said edges to said major support sheet; said major flexible support sheet having one major face adherently affixed to the membrane and having a second major surface substantially nonadherent to the composition to the membrane, said at least one minor support sheet having both major faces substantially non-adherent to the composition of the membrane.

2. The structure of claim 1 wherein said support comprises the major support sheet, a first minor support extending from one edge of said membrane toward said major support sheet and a second minor support sheet extending from the opposite edge of said membrane toward said major support sheet.

3. The structure of claim 1 wherein the membrane is a bitumen composition of from about 75 to 95 percent bitumen and from 5 to 25 percent of a substance selected from rubber, synthetic resin and mixtures thereof.

4. The structure of claim 3 wherein the support sheets are in the form of films or woven or unwoven fabric.

5. The structure of claim 4 wherein each non-adherent face of the support sheets has a release composition coated thereon.

6. The structure of claim 4 wherein the support sheets are films formed from polymeric material.

7. The structure of claim 4 wherein the support sheets are woven or nonwoven fabric formed from polymeric or glass fibers.

8. The structure of claim 4 wherein the non-adherent face of said major support sheet has a high degree of non-adherence with respect to the composition of the membrane, the non-adherent face of each of said at least one minor support sheet in face-to-face relationship with the membrane has a low degree of non-adherence with respect to the adhesive membrane and the other non-adherent face of each of said at least one minor support sheet has a high degree of non-adherence with respect to the adhesive membrane.

9. The structure of claim 8 wherein the high degree of non-adherency is produced by a coating of high degree release agent and the low degree of non-adherency is produced by a coating of low degree release agent.

10. A method of waterproofing a substructural surface comprising (A) applying to the substructural surface a course of a preformed, flexible, sheet-like waterproofing material having a laminated structure of (1) a waterproof and waterproofing flexible pressure sensitive adhesive membrane having one free major surface and a support covered surface extending from edge to edge of said membrane and comprising (a) a major flexible support sheet superimposed on a major portion of said surface, and (b) at least one minor support sheet superimposed on a minor portion of said surface and extending from one of said edges to said major support sheet; said major flexible support sheet having one major face adherently affixed to the membrane and having a second major face substantially non-adherent to the composition of the membrane; said at least one minor support sheet having both major faces substantially non-adherent to the composition of the membrane;

said free surface of the adhesive membrane applied adjacent to the substructural surface;

(3) removing a minor support sheet to expose a minor surface portion of the adhesive membrane;

(C) applying an additional course of said laminate structure with the free surface of the membrane superimposed on the exposed surface portion of the membrane of the previously applied course and on the adjacent substructural surface; and (D) repeating steps (B) and (C) until the desired surface of the substructure is covered.

11. The method of claim 10 wherein the substantially non-adherent faces of each of said at least one minor support sheet has a high degree of non-adherence with respect to the composition of the membrane and the non-adherent face of each of said at least one minor support sheets in face-to-face relationship with the membrane has a low degree of non-adherence with respect to the adhesive membrane.

12. The structure of claim 1 wherein the support comprises two support sheets which together extend from edge to edge of said membrane, said support having a first support sheet super-imposed on a major portion of said membrane surface and having a second support sheet superimposed on a minor portion of said surface and extending from one edge of said membrane to said first support sheet.

13. The structure of claim 2 or 12 wherein the minor support sheet has a width of from about 3 cm to about 20 cm.

* * * * *

UNITED STATES PATENT AND TRADEMARK OFFICE

CERTIFICATE OF CORRECTION

PATENT NO. : 4,172,830

DATED : October 30, 1979

INVENTOR(S) : Arnold M. Rosenberg and James M. Gaidis

It is certified that error appears in the above-identified patent and that said Letters Patent are hereby corrected as shown below:

Column 8, line 21, delete "(3)" and insert therefore --(B)--.

Signed and Sealed this

*Fifteenth* Day of *January 1980*

[SEAL]

*Attest:*

SIDNEY A. DIAMOND

*Attesting Officer*

*Commissioner of Patents and Trademarks*